US012534847B2

(12) United States Patent
Yoon et al.

(10) Patent No.: US 12,534,847 B2
(45) Date of Patent: Jan. 27, 2026

(54) CLOTHES TREATMENT APPARATUS

(71) Applicant: LG Electronics Inc., Seoul (KR)

(72) Inventors: Taejun Yoon, Seoul (KR); Hyungkyu Lim, Seoul (KR); Jeongryeol Choi, Seoul (KR); Hyoungsup Park, Seoul (KR); Youngjin Doh, Seoul (KR); Sunghoo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/886,453

(22) Filed: Sep. 16, 2024

(65) Prior Publication Data

US 2025/0003140 A1 Jan. 2, 2025

Related U.S. Application Data

(63) Continuation of application No. 18/376,323, filed on Oct. 3, 2023, now Pat. No. 12,091,811, which is a continuation of application No. 18/349,563, filed on Jul. 10, 2023, now Pat. No. 12,139,845, which is a continuation of application No. 17/873,643, filed on (Continued)

(51) Int. Cl.

| | |
|---|---|
| ***D06F 58/24*** | (2006.01) |
| ***D06F 73/02*** | (2006.01) |
| ***D06F 87/00*** | (2006.01) |
| *D06F 58/10* | (2006.01) |

(52) U.S. Cl.

CPC ..... *D06F 58/24* (2013.01); *D06F 73/02* (2013.01); *D06F 87/00* (2013.01); *D06F 58/10* (2013.01)

(58) Field of Classification Search

None

See application file for complete search history.

(56) References Cited

U.S. PATENT DOCUMENTS

| | | | |
|---|---|---|---|
| 5,131,623 | A | 7/1992 | Giordani |
| 11,739,473 | B2 | 8/2023 | Yoon et al. |

(Continued)

FOREIGN PATENT DOCUMENTS

| | | | |
|---|---|---|---|
| CN | 101387071 | A | 3/2009 |
| EP | 2762633 | A1 | 8/2014 |

(Continued)

OTHER PUBLICATIONS

Extended European Search Report in European Appln. No. 15201349.6, mailed on May 6, 2016, 10 pages.

(Continued)

*Primary Examiner* — Cristi J Tate-Sims

(74) *Attorney, Agent, or Firm* — Fish & Richardson P.C.

(57) ABSTRACT

A clothes treatment apparatus includes a cabinet defining a treatment chamber configured to accommodate hanging clothes and a cycle chamber configured to house machinery, the cycle chamber being positioned vertically below the treatment chamber. The clothes treatment apparatus also includes a partition plate that partitions the treatment chamber from the cycle chamber, a door configured to open and close the cabinet, a door liner disposed at an inside of the door and configured to guide condensed water generated in the treatment chamber to an upper side of the partition plate, a condensed water guide member disposed at the partition plate and configured to guide the condensed water from the door liner into the treatment chamber.

10 Claims, 9 Drawing Sheets

Related U.S. Application Data

Jul. 26, 2022, now Pat. No. 11,739,473, which is a continuation of application No. 16/950,303, filed on Nov. 17, 2020, now Pat. No. 11,453,972, which is a continuation of application No. 16/860,696, filed on Apr. 28, 2020, now Pat. No. 11,136,709, which is a continuation of application No. 15/948,262, filed on Apr. 9, 2018, now Pat. No. 10,676,860, which is a continuation of application No. 14/973,862, filed on Dec. 18, 2015, now Pat. No. 9,938,657.

(56) References Cited

U.S. PATENT DOCUMENTS

| | | | | |
|---|---|---|---|---|
| 2009/0151193 | A1* | 6/2009 | Moon | D06F 58/20 34/621 |
| 2009/0241606 | A1 | 10/2009 | Yoo et al. | |
| 2014/0238086 | A1* | 8/2014 | Choi | D06F 58/20 68/20 |
| 2016/0208429 | A1 | 7/2016 | Park et al. | |
| 2022/0356634 | A1 | 11/2022 | Yoon et al. | |

FOREIGN PATENT DOCUMENTS

| | | | |
|---|---|---|---|
| JP | S49-039059 | U | 4/1974 |
| JP | S52-144281 | U | 11/1977 |
| JP | 2002-292199 | A | 10/2002 |
| JP | 2010-253132 | A | 11/2010 |
| KR | 10-2008-0062617 | A | 7/2008 |
| KR | 10-2009-0013949 | A | 2/2009 |
| KR | 10-2009-0013983 | A | 2/2009 |
| KR | 10-2014-0108454 | A | 9/2014 |
| WO | WO 2007/132982 | A1 | 11/2007 |
| WO | WO 2009/123407 | A2 | 10/2009 |

OTHER PUBLICATIONS

Extended European Search Report in European Appln. No. 20184481.8, mailed Mar. 12, 2021, 11 pages.

International Search Report and Written Opinion in International Appln. No. PCT/KR2015/013994, mailed on Apr. 27, 2016, 11 pages.

Office Action in Chinese Appln. No. 201510963542.3, mailed on Jun. 2, 2017, 15 pages (with English translation).

Office Action in U.S. Appl. No. 18/349,563, mailed on Feb. 21, 2024, 11 pages.

Yoshitoshi, Sauna Device, Nov. 11, 2010, JP 2010-253132 A translation (Year: 2010).

* cited by examiner

CLOTHES TREATMENT APPARATUS

CROSS-REFERENCE TO RELATED APPLICATIONS

This application is a continuation of U.S. application Ser. No. 18/376,323, filed on Oct. 3, 2023, which is a continuation of U.S. application Ser. No. 18/349,563, filed on Jul. 10, 2023, which is a continuation of U.S. application Ser. No. 17/873,643, filed on Jul. 26, 2022, now U.S. Pat. No. 11,739,473, which is a continuation of U.S. application Ser. No. 16/950,303, filed on Nov. 17, 2020, now U.S. Pat. No. 11,453,972, which is a continuation of U.S. application Ser. No. 16/860,696, filed on Apr. 28, 2020, now U.S. Pat. No. 11,136,709, which is a continuation of U.S. application Ser. No. 15/948,262, filed on Apr. 9, 2018, now U.S. Pat. No. 10,676,860, which is a continuation of U.S. application Ser. No. 14/973,862, filed on Dec. 18, 2015, now U.S. Pat. No. 9,938,657, which claims the priority benefit of Korean Patent Application No. 10-2014-0184455, filed on Dec. 19, 2014. The disclosures of the prior applications are incorporated by reference in their entirety.

TECHNICAL FIELD

The present disclosure relates to a clothes treatment apparatus.

BACKGROUND

Clothes treatment apparatuses are apparatuses that can treat clothes, e.g. wash and dry clothes and smooth wrinkles in clothes, at home or at laundromats.

Clothes treatment apparatuses may be classified into a washer for washing clothes, a dryer for drying clothes, a washer/dryer having both a washing function and a drying function, a refresher for refreshing clothes, and a steamer for removing unnecessary wrinkles in clothes.

The refresher is an apparatus that can keep clothes comfortable and fresh. The refresher functions, for example, to dry clothes, to supply fragrance to clothes, to prevent the occurrence of static electricity in clothes, or to remove wrinkles from clothes.

The steamer is an apparatus that may simply supply steam to clothes in order to remove wrinkles from the clothes. Unlike a general iron, the steamer can remove wrinkles from the clothes without directly applying heat to the clothes.

A clothes treatment apparatus having both the functions of a refresher and a steamer may remove wrinkles from clothes received in the clothes treatment apparatus, and may additionally deodorize the clothes, using steam and hot air.

SUMMARY

According to one aspect, a clothes treatment apparatus includes a cabinet defining a treatment chamber configured to accommodate hanging clothes and a cycle chamber configured to house machinery, the cycle chamber being positioned vertically below the treatment chamber. The clothes treatment apparatus also includes a partition plate that partitions the treatment chamber from the cycle chamber, a door configured to open and close the cabinet, a door liner disposed at an inside of the door and configured to guide condensed water generated in the treatment chamber to an upper side of the partition plate, a condensed water guide member disposed at the partition plate and configured to guide the condensed water from the door liner into the treatment chamber.

Implementations according to this aspect may include one or more of the following features. For example, the partition plate may include a drainage grill configured to discharge the condensed water from the treatment chamber, and the condensed water guide member is inclined toward the drainage grill. The condensed water guide member may include a backward slope portion such that a front side of the backward slope portion is vertically higher than a rear side of the backward slope portion. In some cases, the partition plate may include a forward slope portion such that a rear side of the forward slope portion is vertically higher than a front side of the forward slope portion. The condensed water guide member may be mounted to a front side end of the partition plate.

In some implementations, the clothes treatment apparatus may further include a gasket mounted to the door, wherein the gasket is configured to, based on the door being closed, come into contact with the condensed water guide member. The gasket may be disposed between the cabinet and the door and configured to, based on the door being closed, seal the treatment chamber. In some cases, the condensed water guide member may include a guide member body disposed at the partition plate, and a guide surface positioned at an upper side surface of the guide member body and configured to guide the condensed water from the door liner into the treatment chamber, the guide surface being inclined to have a backward slope such that a front side of the guide surface is vertically higher than a rear side of the guide surface.

Additionally, the door liner may include a drop part configured to allow condensed water to drop from the drop part, the drop part being located at the upper side of the partition plate. The drop part may have an undercut shape. In some cases, at least a portion of the door liner may be located in the treatment chamber at the upper side of the partition plate based on the door being closed. The partition plate may include a drainage grill configured to discharge the condensed water from the treatment chamber, and the door liner includes a drop part configured to allow the condensed water to drop from the drop part, the drop part being located at an upper side of the condensed water guide member. The condensed water guide member may include a guide surface configured to receive the condensed water dropped from the drop part, the guide surface having a backward slope such that a front side of the guide surface is vertically higher than a rear side of the guide surface. The partition plate may have a forward slope such that a rear side of the partition plate is vertically higher than a front side of the partition plate, the partition plate being configured to guide the condensed water in the treatment chamber to the drainage grill along the forward slope.

In some cases, the clothes treatment apparatus according to this aspect may further include a tank installation space disposed at a lower side of the partition plate such that the tank installation space is partitioned from the cycle chamber, the tank installation space being open toward a front of the cabinet, wherein the condensed water guide member is located at an upper side of the tank installation space. The partition plate may include a drainage grill configured to discharge the condensed water from the treatment chamber, and the door liner includes a drop part configured to allow the condensed water to drop from the drop part, the drop part being located at an upper side of the condensed water guide member. The condensed water guide member may include a guide surface configured to receive the condensed water dropped from the drop part, the guide surface having a backward slope such that a front side of the guide surface is vertically higher than a rear side of the guide surface.

In some implementations, the clothes treatment apparatus may further include a drainage tank installed in the tank installation space and configured to store the condensed water, a drainage channel that fluidically connects the drainage grill and the drainage tank to each other, and a drainage pump disposed in the drainage channel. In some cases, the condensed water guide member may include a guide member body disposed at the partition plate, and a guide surface located at an upper side surface of the guide member body and configured to guide the condensed water dropped from the door liner into the treatment chamber, the guide surface being inclined to have a backward slope such that a front side of the guide surface is vertically higher than a rear surface of the guide surface. Additionally, the door liner may include a liner part attached to an inside of the door panel, and a liner guide part located at a lower end of the liner part such that the liner guide part protrudes into the treatment chamber in a deviating fashion, the liner guide part being located at an upper side of the guide surface. The clothes treatment apparatus may also include a tank installation space disposed at a lower side of the partition plate such that the tank installation space is partitioned from the cycle chamber, the tank installation space being open toward a front of the cabinet, wherein the condensed water guide member is located at an upper side of the tank installation space, and a gasket mounted to the door, wherein the gasket is configured to, based on the door being closed, come into contact with the condensed water guide member and restrict the condensed water in the treatment chamber from flowing into the tank installation space.

BRIEF DESCRIPTION OF THE DRAWINGS

The disclosure will be described in detail with reference to the following drawings in which like reference numerals refer to like elements wherein.

DETAILED DESCRIPTION

Figure 1:
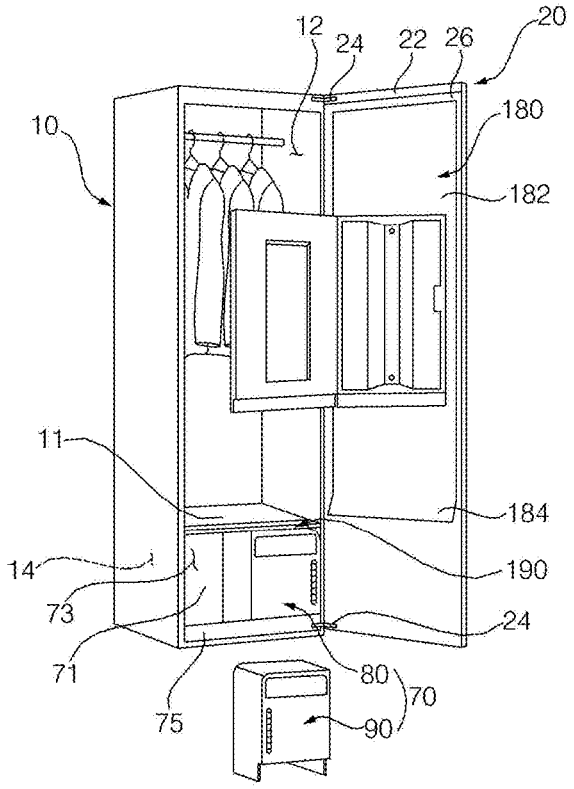
FIG. 1 is a perspective view of an example clothes treatment apparatus.

An example of a clothes treatment apparatus is described with reference to FIGS. 1 to 13.

The clothes treatment apparatus according to one implementation includes a cabinet 10 and a door 20 configured to open and close the front of the cabinet 10.

The interior of the cabinet 10 may be partitioned into upper and lower interior parts by a partition plate 11. A treatment chamber 12, in which clothes are hung, may be defined in the interior of the cabinet 10 above the partition plate 11. A cycle chamber 14, in which machinery is installed, may be defined in the interior of the cabinet 10 below the partition plate 11.

Clothes can be hung in the treatment chamber 12. In the treatment chamber 12, wrinkles in the clothes may be smoothed, or the clothes may be deodorized, by the circulation of steam or air.

Figure 2:
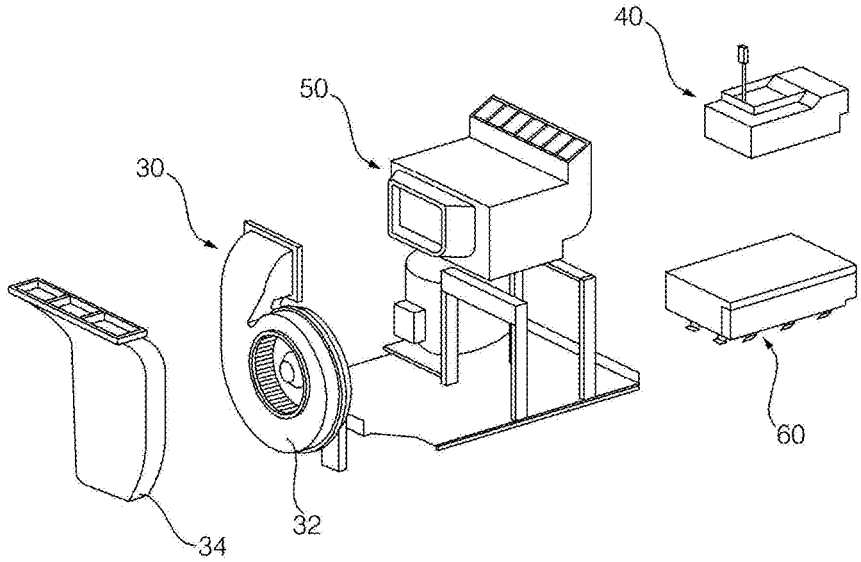
FIG. 2 is an exploded perspective view of an example cycle assembly.
Figure 3:
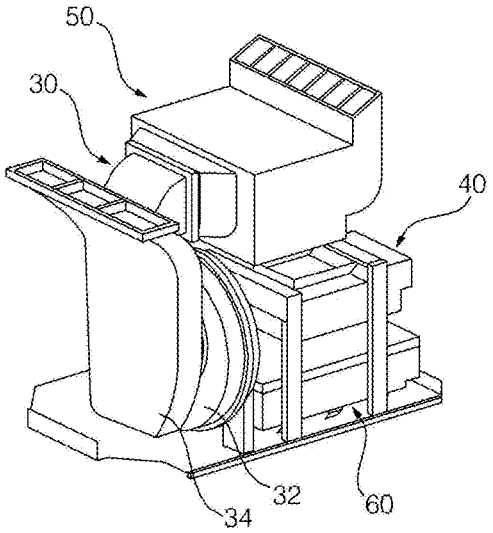
FIG. 3 is a perspective view of the cycle assembly shown in FIG. 2.
Figure 4:
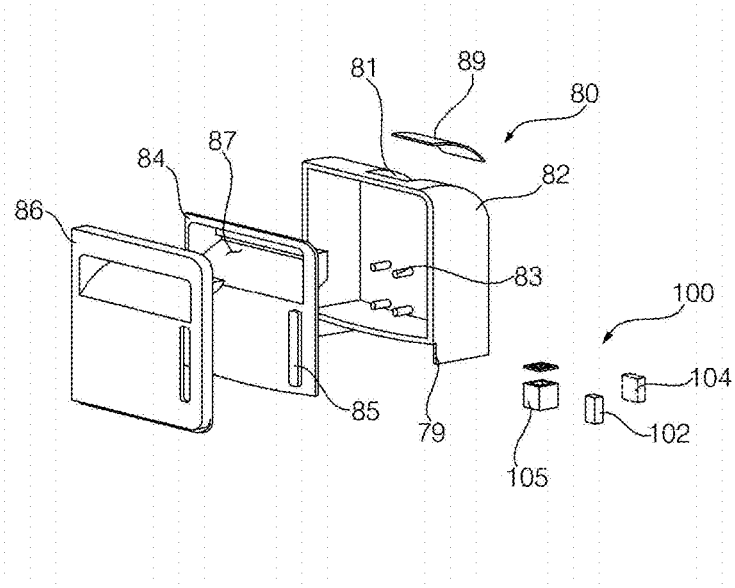
FIG. 4 is an exploded perspective view of a water supply tank shown in FIG. 1.
Figure 5:
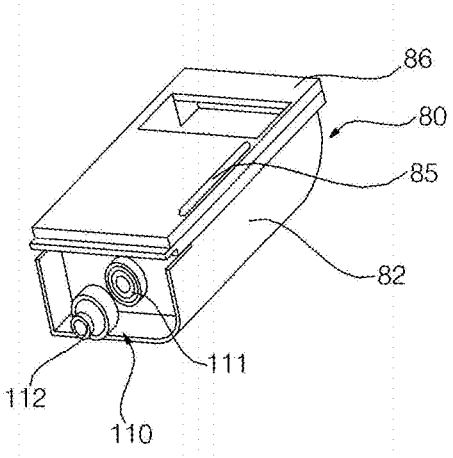
FIG. 5 is a partially exploded perspective view of the water supply tank shown in FIG. 1.
Figure 6:
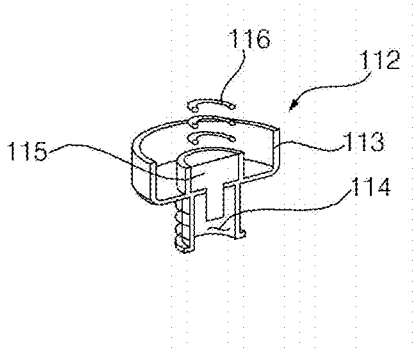
FIG. 6 is a sectional perspective view of a check assembly shown in FIG. 5.
Figure 7:
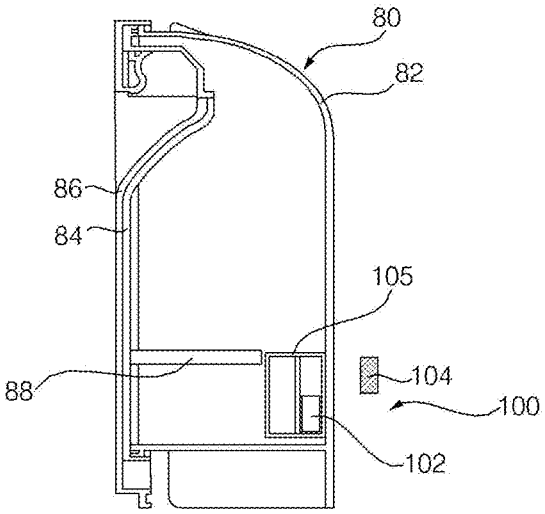
FIG. 7 is a side sectional view of the water supply tank shown in FIG. 1.

Referring further to FIGS. 2-3, a blowing unit 30 for circulating air in the treatment chamber 12, a steam unit 40 for supplying steam into the treatment chamber 12, a heat pump unit 50 for conditioning air in the treatment chamber 12, and a control unit 60 for controlling the respective units 30, 40, and 50 may be installed in the cycle chamber 14.

An assembly of machinery, including the blowing unit 30, the steam unit 40, the heat pump unit 50, and the control unit 60, which are required to perform respective cycles of the clothes treatment apparatus, may be defined as a cycle assembly.

The blowing unit 30 includes a blowing fan 32 and an inlet duct 34.

The inlet duct 34 may be installed at the suction side of the blowing fan 32 to guide air in the treatment chamber 12 to the blowing fan 32.

The blowing fan 32 is rotated to blow air. The blowing fan 32 suctions air from the treatment chamber 12, and discharges the suctioned air to the heat pump unit 50.

When the steam unit 40 is powered on, heat is generated from the steam unit 40. The steam unit 40 converts water supplied from a water supply tank 80, which will be described hereinafter, into steam. The generated steam is discharged into the treatment chamber 12.

In some cases, a flow channel may be defined such that the steam flows into the treatment chamber 12 via the heat pump unit 50.

The heat pump unit 50, which can perform a heat pump cycle, includes a compressor, a condenser, an evaporator, and an expansion valve. Based on the operation mode of the heat pump unit 50, cooled air or heated air may be discharged into the treatment chamber 12.

In particular, the heat pump unit 50 may dehumidify air supplied from the blowing unit 30.

A tank module 70 for storing water may be installed in front of the cycle chamber 14. The tank module 70 includes a water supply tank 80 for supplying water to the steam unit 40 and a drainage tank 90 for gathering and storing condensed water that is generated in the treatment chamber 12.

Water from the water supply tank 80 may flow to the steam unit 40 via a water supply pump 45.

Water that is condensed in the treatment chamber 12 flows to the lower side of the treatment chamber 12 due to gravity, and is then pumped to the drainage tank 90 by a drainage pump 46. Water that is condensed in the heat pump unit 50 also flows to the drainage tank 90 via the drainage pump 46.

The water supply pump 45 or the drainage pump 46 may be controlled by the control unit 60.

In some cases, a tank module frame 71 may be installed in front of the inlet duct 34.

A tank installation space 73 may be defined between the tank module frame 71 and the door 20. The tank module frame 71 may be coupled to the partition plate 11 to isolate the cycle chamber 14 from the outside.

A tank support bar 75, which blocks one or both of the water supply tank 80 and the drainage tank 90, may be installed in front of the tank installation space 73.

The tank support bar 75 helps prevent the water supply tank 80 or the drainage tank 90 from being unintentionally separated from the tank installation space 73. The tank support bar 75 supports the front of the water supply tank 80 and the front of the drainage tank 90.

When the door 20 is opened and closed, therefore, the water supply tank 80 and the drainage tank 90 may be prevented from being separated from the tank installation space 73.

In some cases, the lower end of the water supply tank 80 may be placed on the upper end of the tank support bar 75, and the lower end of the drainage tank 90 may be placed on the upper end of the tank support bar 75.

A tank support end 79, which interferes with the tank support bar 75, may be formed on at least one selected from between the water supply tank 80 and the drainage tank 90.

The tank support end 79 may be concavely recessed.

The front of the tank support bar 75 and the front of the water supply tank 80 may form a continuous surface due to the tank support end 79. In addition, the front of the tank support bar 75 and the front of the drainage tank 90 may form a continuous surface due to the tank support end 79.

The water supply tank 80 and the drainage tank 90 may be disposed in the tank installation space 73 such that the water supply tank 80 and the drainage tank 90 are arranged parallel to each other in rightward and leftward directions.

When the door 20 is opened, the water supply tank 80 and the drainage tank 90 may be exposed to a user.

The water supply tank 80 and the drainage tank 90 may be withdrawn by the user.

The water supply tank 80 and the drainage tank 90 may be separated from the tank module frame 71. The water supply tank 80 and the drainage tank 90 may be separably mounted in the tank installation space 73.

The water supply tank 80 may be connected to the steam unit 40 to supply water to the steam unit 40. The drainage tank 90 may be connected to the treatment chamber 12 to store water discharged from the treatment chamber 12 or the heat pump unit 50.

The water supply tank 80 can include a tank body 82, which is open at the front thereof, a tank cover 84 coupled to the front of the tank body 82, a decorative cover 86 coupled to the tank cover 84, a water supply check valve 110 installed in the tank body 82 for opening and closing a flow channel connected with the steam unit 40, and a water supply level sensor 100 for sensing the level of water stored in the tank body 82.

The front of the tank body 82 may be open. The water supply level sensor 100 may be disposed in the tank body 82.

The upper end of the tank body 82 may be round at the rear side thereof.

When the tank body 82 is separated, interference between the tank body 82 and the partition plate 11 may be minimized.

The user may easily pull and withdraw the water tank 80, which is disposed at the lower side of the clothes treatment apparatus, due to the round shape of the tank body 82.

In some cases, referring further FIGS. 4-7, the water supply level sensor 100 may include a float 102 installed in the tank body 82 such that the float 102 can move upward and downward based on the level of water stored in the tank body 82, a float cabinet 105 installed in the tank body 82 in a state in which the float 102 is disposed in the float cabinet 105, and a sensor 104 installed at the tank module frame 71 to sense the float 102.

The float 102 can include a magnet. The sensor 104 may sense the magnetic force of the magnet.

The sensor 104 may be installed at the front or rear of the tank module frame 71.

The sensor 104 may be installed through the tank module frame 71.

Consequently, the sensor 104 may be located in any one selected from among the cycle chamber 14, the tank installation space 73, and the tank module frame 71.

The float 102, which is installed in the water supply tank 80, may be flush with the sensor 104. When the level of water stored in the water supply tank 80 is lowered, the float 102 may move lower than the sensor 104. When the sensor 104 fails to sense the float 102, therefore, the control unit 60 may output a water deficiency signal. Even when the water deficiency signal is output, it may be possible to supply a sufficient amount of steam during a cycle that is currently being performed.

Since the sensor 104 may constantly senses the float 102, the control unit 60 may determine whether the water supply tank 80 is mounted.

For example, when the water supply tank 80 is not mounted, or when water is deficient, the control unit 60 can output a water deficiency signal.

When the user manipulates the clothes treatment apparatus in a state in which the water deficiency signal is output, therefore, the control unit 60 can perform control such that the clothes treatment apparatus is not operated and outputs a water deficiency signal. At this time, the user may check the water supply tank 80.

A float installation part 83, at which the float 102 is installed, is formed at the inside of the tank body 82. The float cabinet 105 is installed at the float installation part 83. The float 102 may move upward and downward along the float cabinet 105 by buoyancy.

In some cases, the float 102 may be installed at the minimum level of water stored in the water supply tank 80, at which it can be possible to supply an amount of steam corresponding to one cycle. Even when the sensor 104 fails to sense the float 102, and therefore the control unit 60 outputs a water deficiency signal, it can be possible to supply an amount of steam corresponding to at least one cycle.

That is, even when a water deficiency signal is sensed during the supply of steam, it can be possible to supply a sufficient amount of steam until a cycle that is currently being performed is completed.

The float cabinet 105, in which the float 102 is mounted, may be manufactured by insert injection molding at the time of die slide injection (DSI) of the tank cover 84 and the tank body 82.

Die slide injection (DSI) is a molding technology that has been developed for blow molding or molding of thin products. DSI may possess various advantages in that no post-processing, such as adhesion or assembly, may be necessary after injection molding, it may be possible to adjust the thickness of a wall more easily than when blow molding or gas molding, it may be possible to provide an excellent surface shape or high dimensional accuracy, and it may be possible to perform DSI more easily than double injection or blow molding.

The tank body 82 and the tank cover 84 may be manufactured by insert injection molding using DSI. During the manufacture of the tank body 82 and the tank cover 84, the float cabinet 105 can be installed in the tank body 82 and the tank cover 84 by insert injection molding. During the manufacture of the tank body 82 and the tank cover 84, the edge of the tank cover 84 may integrally couple to the edge of the tank body 82.

The tank cover 84 may have a window 85, through which the user may check the level of water in the tank body 82. In addition, a grip 87, into which the user may insert his/her hand in order to hold the tank cover 84, may be concavely formed at the tank cover 84.

The grip 87 may be formed at the tank cover 84 such that the grip 87 is concave from the front to the rear thereof.

A sensor fixing part 88 may be formed at the inside of the tank cover 84. The sensor fixing part 88 protrudes from the inside of the tank cover 84. When the tank cover 84 and the tank body 82 are coupled to each other, the sensor fixing part 88 may come into tight contact with the float cabinet 105.

Since the sensor fixing part 88 can tightly contact the float cabinet 105, the float cabinet 105 can be prevented from being separated from the float installation part 83.

The sensor fixing part 88 may be integrally formed with the tank cover 84.

The decorative cover 86 may be formed to have a shape that is capable of covering the front of the tank cover 84. In addition, the decorative cover 86 may be formed to have a shape corresponding to the shape of the tank cover 84.

A water hole 82 may be formed at the upper side of the tank body 92. In addition, a water hole cover 89 for opening and closing the water hole 82 may be disposed at the upper side of the tank body 92.

The water hole cover 89 may be made of a flexible material exhibiting high elasticity. One end of the water hole cover 89 may be fixed to the tank body 82, and the other end of the water hole cover 89 may be bent in order to open and close the water hole 82.

The water supply check valve 110 can include a check valve hole 111 formed at the lower side of the tank body 82 and a check assembly 112 coupled to the check valve hole 111 for regulating the water in the tank body 82.

The check assembly 112 can include a check housing 113 coupled into the check valve hole 111, the check housing 113 having a check flow channel 114, through which water flows into the check housing 113, a valve 115 disposed in the check housing 113 for opening and closing the check flow channel 114, and a check elastic member 116 disposed between the valve 115 and the tank body 82 for applying elastic force to the valve 115.

The small-diameter side of the valve 115 may protrude downward. When the valve 115 is placed on the tank module frame 71, the valve 115 may be pushed by the tank module frame 71, and may thus move upward. At this time, the check flow channel 114 is opened as the result of the movement of the valve 115. When the water supply tank 80 is separated from the tank module frame 71, the check flow channel 114 is closed by the elastic force of the check elastic member 116.

Figure 8:
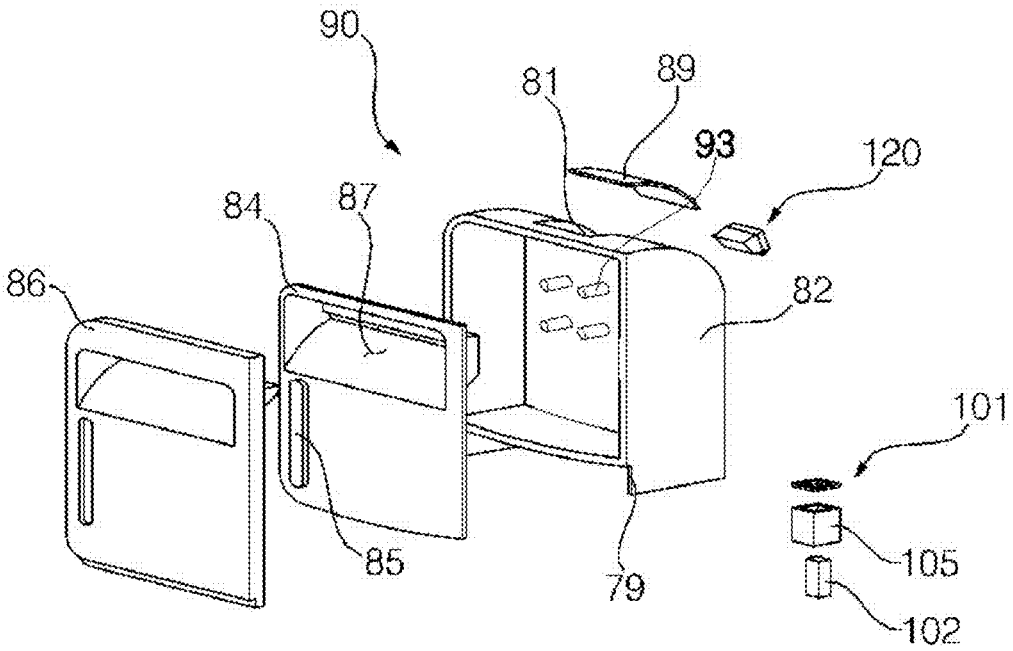
FIG. 8 is a perspective view of a drainage tank shown in FIG. 1.
Figure 9:
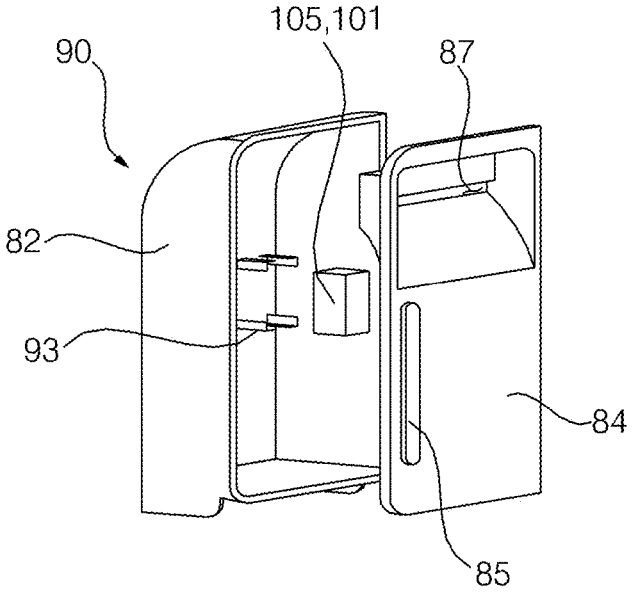
FIG. 9 is a partially exploded perspective view of the drainage tank shown in FIG. 1.
Figure 10:
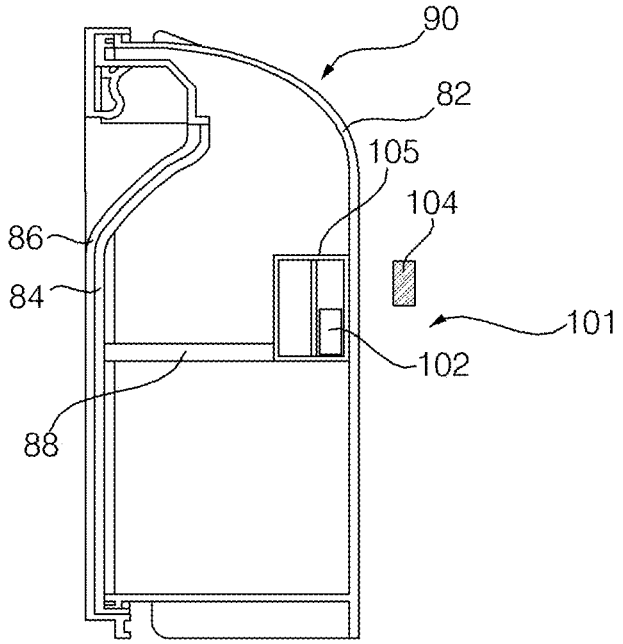
FIG. 10 is a side sectional view of the drainage tank shown in FIG. 1.

The drainage tank 90, further shown in FIGS. 8-10, is essentially identical in function to the water supply tank 80. The drainage tank 90 may be disposed alongside the water supply tank 80.

In the drainage tank 90, a drainage check valve 120 may be installed at the rear side thereof, not at the lower side thereof, unlike the water supply tank 80.

The water supply tank 80 receives water through the water hole 81, and discharges water through the water supply check valve 110. The drainage tank 90 may receive condensed water through the drainage check valve 120, and may discharge condensed water through the water hole 81.

That is, the drainage check valve 120 of the drainage tank 90 may be disposed in a channel for receiving condensed water, not for discharging condensed water.

In some cases, condensed water may fall into the drainage tank 90 through the water hole 81. In addition, condensed water may be automatically discharged through the drainage check valve 120.

Water that is condensed in the treatment chamber 12 and water that is condensed in the heat pump unit 50 may be stored in the drainage tank 90.

A float installation part 93, at which the float cabinet 105 is installed, may be formed in the drainage tank 90.

The float installation part 93 may be located at a height in the drainage tank 90 at which overflow does not occur even when an amount of condensed water that is generated during one cycle is stored therein.

That is, the float installation part 93 may be located at a height in the drainage tank 90 at which overflow does not occur even when an amount of condensed water that is generated during one cycle is stored in the drainage tank 90.

When a drainage level sensor 101 of the drainage tank 90 senses a signal during the operation of the clothes treatment apparatus, therefore, the water in the drainage tank 90 does not overflow due to the condensed water that is additionally stored in the drainage tank 90.

The drainage level sensor 101 of the drainage tank 90 is located higher than the water supply level sensor 100 in the water supply tank 80.

The drainage level sensor 101 of the drainage tank 90 may be identical in construction to the water supply level sensor 100 of the water supply tank 80. However, the drainage level sensor 101 of the drainage tank 90 may be operated differently from the water supply level sensor 100 of the water supply tank 80.

For example, the sensor 104 of the drainage tank 90 does not sense the float 102 in a normal state. When the level of condensed water rises, the sensor 104 of the drainage tank 90 senses the float 102, which has been raised by buoyancy.

When the sensor 104 of the drainage tank 90 senses the float 102, the control unit 60 outputs a water drainage signal. When the water drainage signal is output, however, the overflow of condensed water does not occur during a cycle that is currently being performed.

Meanwhile, a lower cabinet 130, on which the water supply tank 80 and the drainage tank 90 are mounted, is disposed at the lower side of the tank installation space 73. The lower cabinet 130 defines the tank installation space 73 together with the tank module frame 71.

The lower cabinet 130 is an element that defines the lower part of the cabinet 10. The lower cabinet 130 is assembled with the tank module frame 71 to support the water supply tank 80 and the drainage tank 90.

Figure 11:
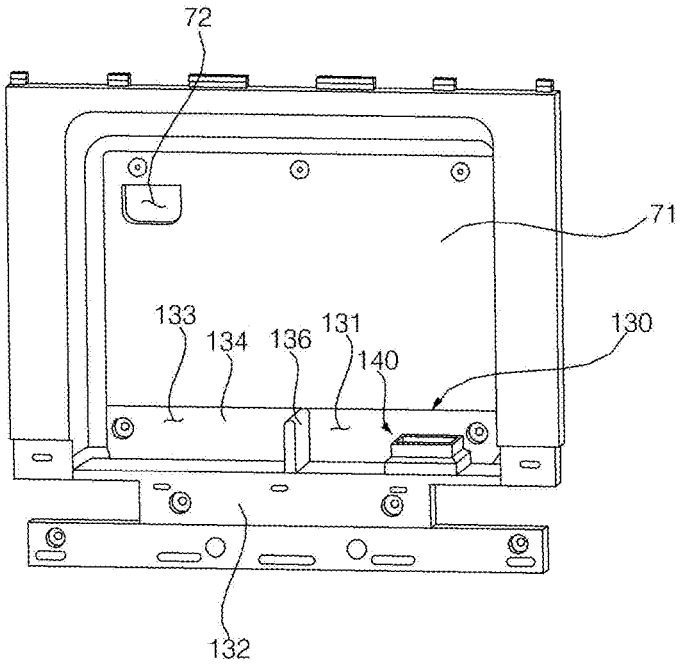
FIG. 11 is a perspective view of a lower cabinet shown in FIG. 1.
Figure 12:
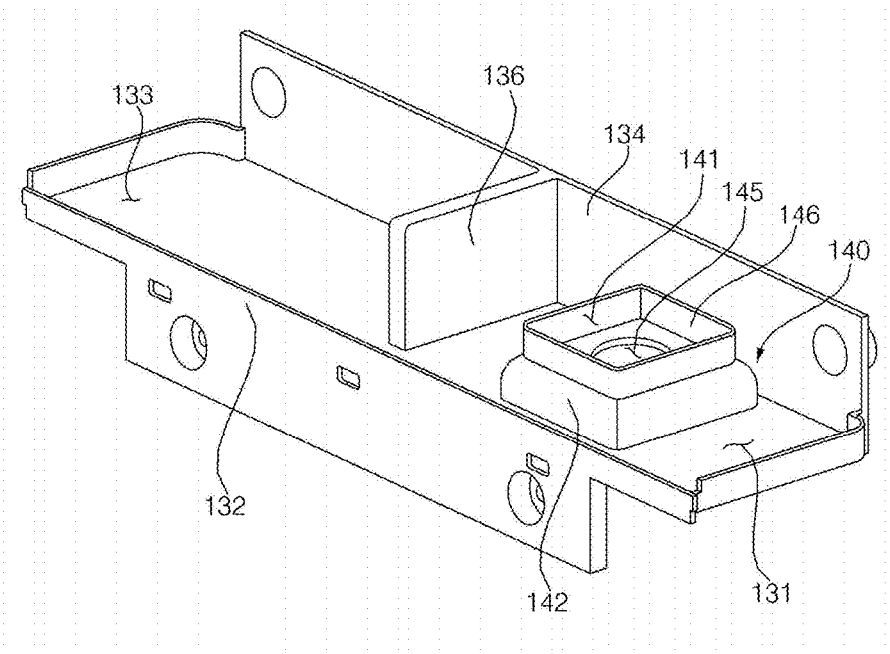
FIG. 12 is a perspective view of the lower cabinet shown in FIG. 11.
Figure 13:
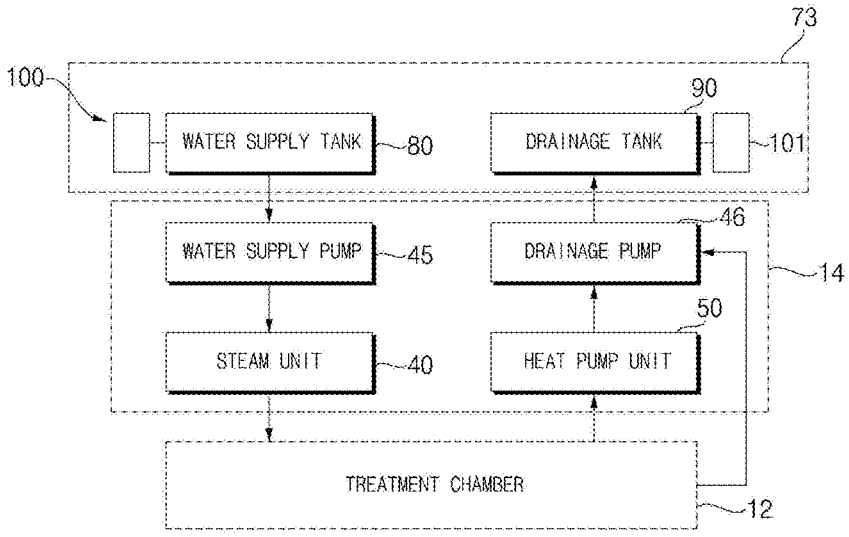
FIG. 13 is an example block diagram of the clothes treatment apparatus.

Hereinafter, the lower cabinet 130 will be described in detail with reference to FIGS. 11 and 12.

The lower cabinet 130 is an element of the cabinet 10.

The lower cabinet 130 may be provided with a flow channel, which connects the water supply tank 80 and the steam unit 40 to each other. The tank module frame 71 may be provided with a flow channel, which connects the drainage tank 90 and the heat pump unit 50 to each other.

The lower cabinet 130 may include a lower base 132, on which the water supply tank 80 and the drainage tank 90 are mounted, and a lower back 134 connected to the lower base 132, the lower back 134 being assembled with the tank module frame 71.

In some cases, a lower partition wall 136 may further provided to partition the lower base 132 into left and right base parts. One part of the lower base 132 partitioned by the lower partition wall 136 is defined as a first installation part 131, and the other part of the lower base 132 partitioned by the lower partition wall 136 is defined as a second installation part 133.

In some cases, the water supply tank 80 may be mounted on the first installation part 131, and the drainage tank 90 is mounted on the second installation part 133. In other cases, the lower partition wall 136 may not be provided.

The lower back 134 can form a continuous surface with the tank module frame 71.

The lower back 134 separates the cycle chamber 14 and the tank installation space 73 from each other together with the tank module frame 71.

The lower back 134 may be disposed perpendicular to the lower partition wall 136.

The lower partition wall 136 may partition an installation space for the water supply tank 80 and an installation space for the drainage tank 90 from each other. In addition, the lower partition wall 136 may help prevent the water supply tank 80 or the drainage tank 90 from interfering with the drainage tank 90 or the water supply tank 80 when the water supply tank 80 or the drainage tank 90 is separated.

As will be described hereinafter, when the water supply tank 80 is shaken or lifted, a small amount of water from the water supply check valve 110 may be discharged into a receiving space 141. When the water from the water supply check valve 110 is repeatedly discharged into the receiving space 141, the water may overflow the receiving space 141. As a result, the water may overflow a water pocket 140. The lower partition wall 136 functions to prevent interference between the water supply tank 80 and the drainage tank 90, which are adjacent to each other.

The water pocket 140 may be disposed on the first installation part 131. The water supply tank 80 may be coupled to the water pocket 140.

The water supply check valve 110 of the water supply tank 80 may be inserted into the water pocket 140.

When the water supply check valve 110 is inserted into the water pocket 140, a flow channel for connecting the water supply tank 80 and the steam unit 40 to each other is defined.

The water pocket 140 can store a predetermined amount of water discharged from the water supply check valve 110.

The water pocket 140 may include a pocket housing 142 formed at the lower base 132 such that the pocket housing 142 protrudes upward from the lower base 132, a water hole 145 formed at the pocket housing 142, the water hole 145 being provided with a flow channel communicating with the steam unit 40, and a water barrier 146 formed at the pocket housing 142, the water barrier 146 defining the receiving space 141 inside the pocket housing 142.

The water hole 145 may be formed inside the pocket housing 142. The pocket housing 142 may be coupled with the water supply check valve 110 of the water supply tank 80. The pocket housing 142 supports the water supply tank 80.

In some cases, the water barrier 146 may protrude upward from the pocket housing 142. Also, in some examples, the pocket housing 142 may be recessed to define the receiving space 141.

A small amount of water may be stored in the receiving space 141. The water hole 145 is located inside the receiving space 141. The water stored in the receiving space 141 may flow to the steam unit 40 via the water hole 145.

The receiving space 141 may be formed so as to be open toward the tank installation space 73.

The water supply tank 80 may be mounted on the water barrier 146 such that the water supply tank 80 is supported by the water barrier 146.

When the water supply tank 80 is mounted on the water pocket 140, the water supply check valve 110 remains open.

As a result, when the water supply tank 80 is separated from the lower cabinet 130, a small amount of water may be discharged through the water supply check valve 110. The discharged water is stored in the receiving space 141. That is, when the water supply tank 80 is separated, a small amount of water discharged while the water supply check valve 110 is closed may be stored in the receiving space 141.

When the water supply tank 80 is repeatedly separated, water discharged through the water supply check valve 110 may overflow the water pocket 140.

A control method that is capable of moving water stored in the receiving space 141 to the steam unit 40 may be provided. As a result, it may be possible to prevent water in the receiving space 141 from overflowing the receiving space 141 when the water supply tank 80 is repeatedly separated.

Figure 14:
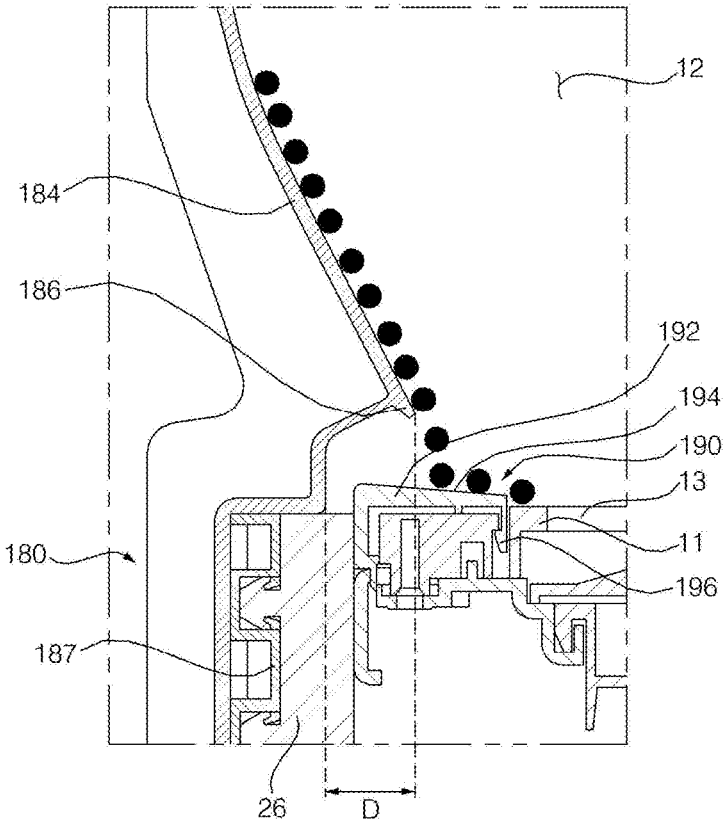
FIG. 14 is a side sectional view showing an example coupled state of a door liner shown in FIG. 1.
Figure 15:
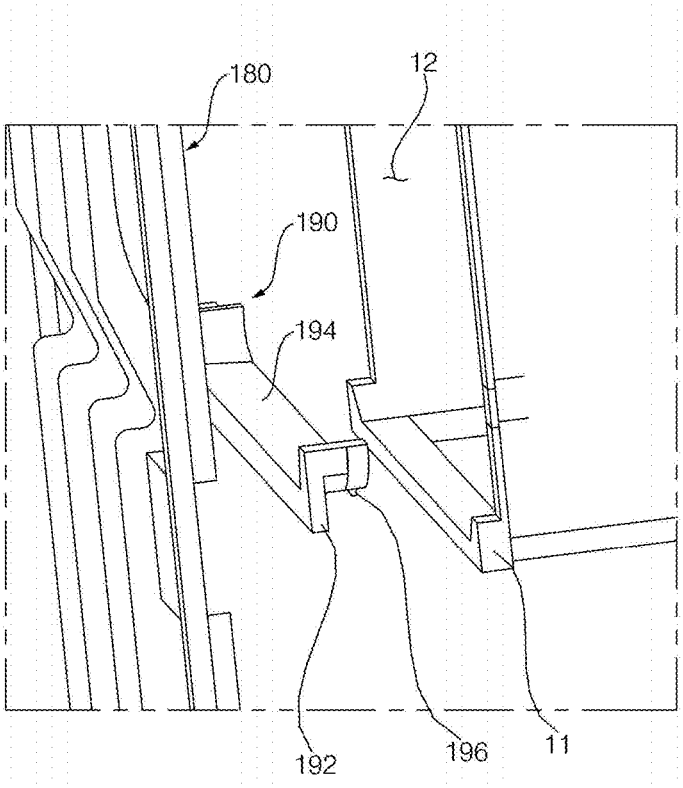
FIG. 15 is an exploded perspective view of a condensed water guide member shown in FIG. 1.

Hereinafter, an example door will be described in detail with reference to FIGS. 14 and 15.

The door 20 (see also FIG. 1) includes a door panel 22 for opening and closing the front of the cabinet 10, a hinge unit 24 for connecting the door panel 22 and the cabinet 10 in a hinged fashion, a door gasket 26 disposed at the door panel 22 such that the door gasket 26 is in tight contact with the edge of the cabinet 10 to achieve a seal between the door 20 and the cabinet 10, and a door liner 180 disposed at the inside of the door panel 2 for guiding condensed water that is generated in the treatment chamber 12 to the partition plate 11.

In some cases, the door 20 may be configured to have a structure that simultaneously opens and closes the treatment chamber 12 and the tank installation space 73. In other cases, a plurality of doors may be mounted to the cabinet 10 such that the respective doors can open and close the treatment chamber 12 and the tank installation space 73.

The door liner 180 may be disposed toward the treatment chamber 12.

The door liner 180 may help guide condensed water that is generated on the surface thereof to a drainage grill 13 formed at the partition plate 11.

The door liner 180 can include a liner part 182, which is attached to the inside of the door panel 22 such that the liner part 182 is parallel to the door panel 22, and a liner guide part 184, which is formed at the lower end of the liner part 182 such that the liner guide part 184 is deviated toward the inside of the treatment chamber 12.

The door liner 180 may be located at the upper side of the partition plate 11. The door liner 180 may have an area slightly less than the area of the front of the treatment chamber 12.

The door gasket 26 may be mounted to the door panel 22 such that the door gasket 26 surrounds the door panel 22.

The seal between the door 20 and the cabinet 10 may be achieved by the door gasket 26.

The door gasket 26 may individually seal the treatment chamber 12 and the tank installation space 73.

The door gasket 26 may prevent condensed water that is generated in the treatment chamber 12 from flowing to the tank installation space 73.

The liner part 182 may be in tight contact with the door panel 22.

In some cases, the liner guide part 184 may be integrally formed with the liner part 182. Alternatively, the liner part 182 and the liner guide part 184 may be manufactured separately.

The liner guide part 184 may be disposed such that the liner guide part 184 is deviated from the liner part 182 toward the treatment chamber 12. The liner guide part 184 may be formed to have a round shape or an inclined surface.

The liner guide part 184 may protrude from the door 20 toward the inside of the treatment chamber 12.

A drop part 186 may be formed at the lower end of the liner guide part 184. The drop part 186 may be formed to have an undercut shape. The drop part 186 can function to increase the size of droplets of condensed water and to drop the droplets downward.

A portion of the door gasket 26 may be disposed at the lower side of the liner guide part 184. The door gasket 26 prevents condensed water that is generated in the treatment chamber 12 from falling to the tank installation space 73.

Meanwhile, the condensed water moves along the liner guide part 184, and drops from the drop part 186. The dropped condensed water falls to a condensed water guide member 190, which is mounted to the partition plate 11. The condensed water guide member 190 moves the condensed water to the drainage grill 13, which is formed at the partition plate 11.

The door gasket 26 may be mounted to the rear of the door 20 such that the door gasket 26 is in tight contact with the front of the condensed water guide member 190.

The door gasket 26 may not only prevent the flow of water but may also reduce impact applied to the door 20 when the door 20 is closed.

The condensed water guide member 190 may be disposed at the front of the drainage grill 13 such that the condensed water guide member 190 can be assembled to the partition plate 11. The condensed water guide member 190 may be located at the upper side of the tank installation space 73. The drainage tank 90 and the water supply tank 80 may be located at the lower side of the tank installation space 73.

The condensed water guide member 190 may be mounted to the front side end of the partition plate 11. The condensed water guide member 190 may be located at the lower side of the drop part 186.

The condensed water guide member 190 may include a guide member body 192 mounted to the partition plate 11, a guide surface 194 formed at the upper side surface of the guide member body 192 for guiding condensed water into the treatment chamber 12, and a coupling part 196 formed at the guide member body 192 for maintaining coupling force between the condensed water guide member 190 and the partition plate 11.

The guide member body 192 may cover a portion of the upper side surface of the partition plate 11. In some cases, the guide member body 192 may be formed to have a '[' shape that is open at the lower side.

In some cases, the coupling part 196 may be formed to have a hook shape such that the coupling part 196 and the partition plate 11 are caught by each other.

The drainage grill 13 may be located at the inside of the partition plate 11. The drainage grill 13 may be located at the inside of the treatment chamber 12.

The guide surface 194 may guide the condensed water to the drainage grill 13.

The guide surface 194 may be formed to have a backward slope that is inclined toward the inside of the treatment chamber 12.

Here, the term "backward slope" is referring to a slope configured such that the front of the slope is high with respect to the cabinet 10 and the rear of the slope is low with respect to the cabinet 10. Conversely, the term "forward slope" is referring to a slope configured such that the front of the slope is low with respect to the cabinet 10 and the rear of the slope is high with respect to the cabinet 10.

The condensed water dropped from the drop part 186 collides with the guide surface 194, and then moves to the drainage grill 13 along the slope of the guide surface 194.

The condensed water guide member 190 extends in leftward and rightward directions. As a result, condensed water that flows along the inside wall of the treatment chamber 12 may also be guided to the drainage grill 13 along the guide surface 194.

The guide surface 194 can help prevent the condensed water that has fallen along the treatment chamber 12 from flowing to the tank installation space 73.

The partition plate 11 may be inclined toward the drainage grill 13. The drainage grill 13 may be located lower than other parts of the partition plate 11.

Condensed water falling from the rear surface and the opposite side surfaces of the treatment chamber 12 may flow to the drainage grill 13 along the slope of the partition plate 11.

In some cases, the condensed water guide member 190 and the partition plate 11 may be manufactured separately, and are then coupled to each other. This is because the direction of the slope of the guide surface 194, which constitutes the condensed water guide member 190, and the direction of the slope of the partition plate 11 are different from each other.

The partition plate 11 may be formed to have a forward slope toward the drainage grill 13, whereas the guide surface 194 is formed to have a backward slope.

In a case in which parts slope in different directions, it can be difficult to manufacture the parts as a single body through injection molding. In some cases, the condensed water guide member 190 and the partition plate 11 may be manufactured separately such that the condensed water guide member 190 has a backward slope and the partition plate 11 has a forward slope. Consequently, the condensed water guide member 190 and the partition plate 11 may guide condensed water to the drainage grill 13.

In some cases, the condensed water guide structure, which is constituted by the door liner 180 and the condensed water guide member 190, may minimize the protruding depth D of the door liner 180.

That is, when condensed water drops to the guide surface 96 of the condensed water guide member 190, the condensed water flows to the drainage grill 13 along the adverse slope. For this reason, the drop part 186 may be located at the upper side of the guide surface 96 rather than the upper side of the drainage grill 13.

Consequently, the protruding depth D of the drop part 186 may be minimized.

In addition, in a case in which the protruding depth D of the liner guide part 184 and the drop part 186 is minimized, it may be possible to easily design a mold for use in manufacturing the door liner 180 and to reduce material costs, thereby reducing manufacturing costs.

In some cases, the door gasket 26 may be located lower than the guide surface 96 of the condensed water guide member 190. Alternatively, the upper side end of the door gasket 26 may be located higher than the guide surface 96. In this case, it is possible to more securely prevent the condensed water from flowing into the tank installation space 73.

A gasket fixing part 187, to which the door gasket 26 is fixed, may be provided at the door liner 180. The door gasket 26 may be coupled and fixed to the gasket fixing part 187 in a hook fashion.

Meanwhile, the condensed water having flowed to the drainage grill 13 is stored in the drainage tank 90 due to the operation of the drainage pump 46. A drainage channel for guiding the condensed water from the drainage grill 13 to the drainage tank 90 may be disposed in the cycle chamber 14.

The drainage pump 46 may be mounted in the drainage channel.

In some cases, the condensed water that has fallen from the rear surface and the opposite side surfaces of the treatment chamber 12 may be guided to the drainage grill 13 along the forward slope of the partition plate 11.

The condensed water that has fallen along the door liner 180, which is the front of the treatment chamber 12, drops from the drop part 186 onto the upper surface of the condensed water guide member 190. The condensed water dropped onto the upper surface of the condensed water guide member 190 is guided to the drainage grill 13 along the adverse slope of the guide surface 194.

The condensed water that has accumulated in the drainage grill 13 is temporarily stored in the drainage channel.

The drainage pump 46 pumps the condensed water that has accumulated in the drainage channel to the drainage tank 90. The drainage channel is connected to the drainage check valve 120.

An installation hole 72, into which the drainage check valve 120 is inserted, may be formed in the tank module frame 71.

The water pumped by the drainage pump 46 can be stored in the drainage tank 90 through the drainage check valve 120.

When the condensed water stored in the drainage tank 90 raises the float 102, the sensor 104 senses the float 102, and transmits a sensing signal to the control unit 60.

As is apparent from the above description, the clothes treatment apparatus may have one or more of the following effects.

First, condensed water that falls along the door liner may drop onto the partition plate. Consequently, it may be possible to prevent the leakage of the condensed water to the outside.

Second, condensed water dropped from the door liner may drop onto the upper side of the condensed water guide member, and may then be guided to the drainage grill, which is provided at the partition plate, along the condensed water guide member. Consequently, it may be possible to easily discharge the condensed water.

Third, the guide surface of the condensed water guide member, onto which condensed water drops, may be is formed to have a backward slope. Consequently, it may be possible to prevent the condensed water from flowing to the tank installation space.

Fourth, the partition plate and the condensed water guide member may be inclined toward the drainage grill. Consequently, it may be possible to easily gather condensed water.

Fifth, the drainage grill may be disposed at the upper side of the drainage tank, in which condensed water is stored. Consequently, it may be possible to minimize the movement distance of the condensed water.

Sixth, the drop part of the door liner may be inserted and located in the treatment chamber. Consequently, it may be possible to maximally prevent condensed water gathering on the drop part from dropping to the outside when the door is opened.

Seventh, the gasket may be brought into tight contact with the front of the condensed water guide member in order to seal the treatment chamber. Consequently, it may be possible to preventing condensed water in the treatment chamber from falling to the tank installation space.

Eighth, condensed water on the door liner may drop to the condensed water guide member, which is located at the front side end of the partition plate. Consequently, it may be possible to minimize the protruding depth of the door liner.

It will be apparent that, although various implementations of the present disclosure have been described above with reference to the accompanying drawings, the present disclosure is not limited to the above-described specific implementations, and therefore various modifications and variations can be made by those skilled in the art without departing from the gist of the appended claims. Thus, it is intended that the modifications and variations should not be understood independently of the technical spirit or prospect of the present disclosure. The above implementations are therefore to be construed in all aspects as illustrative and not restrictive.

What is claimed is:

1. A clothes treatment apparatus comprising:

a cabinet;

a door disposed at a front of the cabinet and configured to open and close the cabinet;

a treatment chamber located inside the cabinet and configured to receive hung clothes, the treatment chamber being configured to be opened and closed by the door;

a cycle chamber located inside the cabinet and below the treatment chamber;

a steam unit disposed in the cycle chamber and configured to supply steam to the treatment chamber;

a heat pump disposed in the cycle chamber and configured to exchange heat with air in the treatment chamber;

a water tank defining a water-storing space therein and configured to at least one of (i) supply water to the steam unit based on the water tank being connected to the steam unit or (ii) receive condensed water generated in the treatment chamber or the heat pump; and a tank installation portion located inside the cabinet and disposed forward of the cycle chamber, defining a tank installation space configured to receive the water tank, having an opening at a front of the tank installation space, wherein at least a portion of the water tank is configured to be inserted through the opening of the tank installation portion to thereby separably couple to the tank installation portion, wherein the tank installation portion comprises:

a lower part configured to support the water tank and define a lower side of the tank installation space, and a frame part configured to define the tank installation space excluding the lower side of the tank installation space defined by the lower part, wherein the lower part includes:

a lower base on which the water tank is seat, a lower back extended upwardly from a back side of the lower base and configured to be assembled with the frame part so that the lower part is assembled with the frame part, a water hole formed through the lower base, configured to communicate with the steam unit, and a water barrier surrounding the water hole and protruding upwardly from the lower base, and wherein the lower back extends higher than the water barrier.

2. The clothes treatment apparatus of claim 1, wherein the lower back is disposed directly behind the water barrier.

3. The clothes treatment apparatus of claim 1, wherein the lower part further includes an edge wall extending upwardly along an edge of the lower base, and wherein the edge wall extends lower than the water barrier.

4. The clothes treatment apparatus of claim 3, wherein the water tank comprises (i) a water supply tank configured to supply water to the steam unit based on the water supply tank being connected to the steam unit and (ii) a drainage tank configured to receive condensed water generated in the treatment chamber or the heat pump, wherein the water supply tank comprises a water supply check provided at a bottom of the water supply tank, wherein the water supply tank and drainage tank are disposed side by side in the tank installation space, wherein the water hole and the water barrier are disposed beneath the water supply tank, wherein the water hole is configured to be connected to and disconnected with a water supply check valve, and wherein the water barrier is configured to surrounding the water supply check valve.

5. The clothes treatment apparatus of claim 4, wherein the lower part further includes a lower partition wall protruding upwardly from the lower base, and positioned between the water supply tank and the drainage tank, and wherein the lower partition wall extends higher than the water barrier.

6. The clothes treatment apparatus of claim 5, wherein the lower partition wall extends higher than the edge wall.

7. The clothes treatment apparatus of claim 6, wherein the tank installation portion further comprises a front support part that is disposed at the lower side of the opening and extends upwardly than a bottom side of the tank installation space, wherein the front support part extends lower than the water barrier.

8. The clothes treatment apparatus of claim 7, wherein the front support part extends lower than the lower partition wall.

9. The clothes treatment apparatus of claim 1, wherein the lower back has an assembly portion configured to be assembled with the frame part.

10. The clothes treatment apparatus of claim 9, wherein the assembly portion is positioned higher than an edge wall of the lower part.

* * * * *